US009261297B2

(12) United States Patent
Guldali et al.

(10) Patent No.: US 9,261,297 B2
(45) Date of Patent: Feb. 16, 2016

(54) COOLING DEVICE

(76) Inventors: Yalcin Guldali, Istanbul (TR); Talip Caglar, Istanbul (TR)

( * ) Notice: Subject to any disclaimer, the term of this patent is extended or adjusted under 35 U.S.C. 154(b) by 559 days.

(21) Appl. No.: 11/573,779

(22) PCT Filed: Jul. 19, 2005

(86) PCT No.: PCT/IB2005/052405

§ 371 (c)(1),
(2), (4) Date: Feb. 15, 2007

(87) PCT Pub. No.: WO2006/018746

PCT Pub. Date: Feb. 23, 2006

(65) Prior Publication Data

US 2007/0240430 A1 Oct. 18, 2007

(30) Foreign Application Priority Data

Aug. 18, 2004 (TR) ..... a 2004 02055

(51) Int. Cl.

| | |
|---|---|
| ***F25B 41/00*** | (2006.01) |
| ***F25D 11/02*** | (2006.01) |
| ***F25B 39/02*** | (2006.01) |
| ***F25B 41/04*** | (2006.01) |
| ***F25B 5/04*** | (2006.01) |

(52) U.S. Cl.

CPC . *F25B 41/04* (2013.01); *F25B 5/04* (2013.01); *F25D 11/022* (2013.01); *F25B 2500/26* (2013.01); *F25B 2600/2507* (2013.01)

(58) Field of Classification Search

CPC ..... F25B 5/04; F25B 2600/2501; F25B 2400/0409

USPC ..... 62/441, 198

See application file for complete search history.

(56) References Cited

U.S. PATENT DOCUMENTS

| | | | | | |
|---|---|---|---|---|---|
| 2,133,964 | A | * | 10/1938 | Buchanan | 62/207 |
| 4,265,093 | A | * | 5/1981 | Newton | 62/198 |
| 4,499,738 | A | * | 2/1985 | Motoyama et al. | 62/155 |
| 4,537,041 | A | * | 8/1985 | Denpou et al. | 62/199 |
| 4,565,070 | A | * | 1/1986 | Raymond | 62/81 |
| 4,748,823 | A | * | 6/1988 | Asano et al. | 62/239 |
| 5,355,697 | A | * | 10/1994 | Morimoto | 62/278 |
| 5,406,805 | A | * | 4/1995 | Radermacher et al. | 62/81 |
| 5,477,915 | A | * | 12/1995 | Park | 165/206 |
| 5,715,693 | A | * | 2/1998 | van der Walt et al. | 62/198 |
| 5,960,642 | A | * | 10/1999 | Kim et al. | 62/513 |
| 6,038,874 | A | * | 3/2000 | van der Walt et al. | 62/198 |
| 6,167,712 | B1 | | 1/2001 | Lim et al. | |
| 6,286,326 | B1 | * | 9/2001 | Kopko | 62/179 |
| 6,370,895 | B1 | * | 4/2002 | Sakuma et al. | 62/199 |
| 6,497,113 | B1 | * | 12/2002 | Yamada et al. | 62/441 |
| 6,526,769 | B2 | * | 3/2003 | Kim | 62/199 |
| 6,883,603 | B2 | * | 4/2005 | Park et al. | 165/206 |
| 7,028,501 | B2 | * | 4/2006 | Casar et al. | 62/324.1 |
| 7,181,921 | B2 | * | 2/2007 | Nuiding | 62/198 |
| 2003/0061822 | A1 | | 4/2003 | Rafalovich | |
| 2004/0083746 | A1 | * | 5/2004 | Kim et al. | 62/198 |
| 2005/0150237 | A1 | | 7/2005 | Yabu et al. | |

FOREIGN PATENT DOCUMENTS

| | | |
|---|---|---|
| WO | WO 03/067160 A | 8/2003 |

* cited by examiner

*Primary Examiner* — Allen Flanigan
*Assistant Examiner* — Filip Zec
(74) *Attorney, Agent, or Firm* — Venjuris P.C.

(57) ABSTRACT

A cooling device performance is improved by controlling the cycle of the refrigerant.

5 Claims, 3 Drawing Sheets

COOLING DEVICE

This invention relates to a cooling device, the cooling performance of which is improved by controlling the cycle of the refrigerant.

In cooling devices, the circulation of the refrigeration fluid through units such as compressor, condenser, capillary tubes and evaporator constitutes the cooling cycle. Especially in refrigerators comprising cooling and freezing compartments, wherein evaporators connected in series, one for each compartment, are utilized, refrigeration fluid circulates through the evaporators following their connection order in the cooling cycle. As a result of this, controlling the cooling temperatures and efficiencies of the evaporators becomes problematic.

For example, in cooling systems with serially connected evaporators, when there is an instantaneous heat load in a compartment, the system can not respond quickly if the evaporator of this compartment is in the last position in the connection order of the cooling cycle.

Moreover, in cooling systems with serially connected evaporators, since the circulation of the refrigerant is in one direction, compartment temperatures can not be controlled independently. In such a system, for example, as the compressor starts operating, refrigeration fluid circulates through the freezing compartment evaporator first. However, the refrigerant, which was heated up in the stand-by phase fills the freezing compartment evaporator following the activation of the compressor. In this transient regime, which starts as the compressor starts operating and ends as the temperature of the refrigerant reaches to a level suitable for cooling, the temperature of the refrigerant entering the freezing compartment evaporator is too high to be used in cooling, so that it may even create a heat load in the compartment.

The object of the present invention is the realization of a cooling device, the cooling performance of which is improved by controlling the cycle of the refrigerant.

Figure 1:
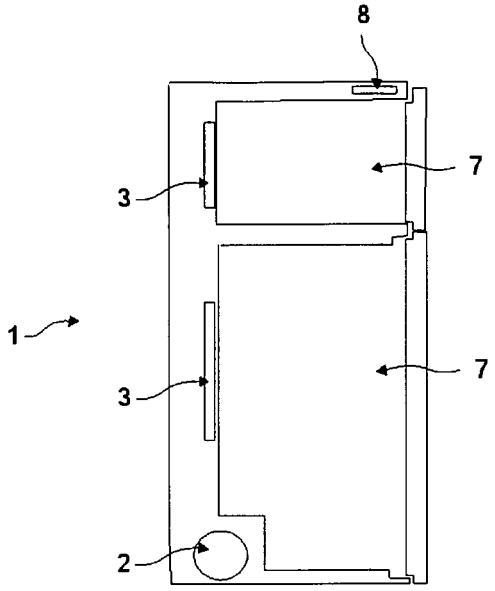

The cooling device designed to fulfill the object of this invention is illustrated in the attached figures, where:

FIG. 1—is a schematic view of a cooling device.

Figure 2:
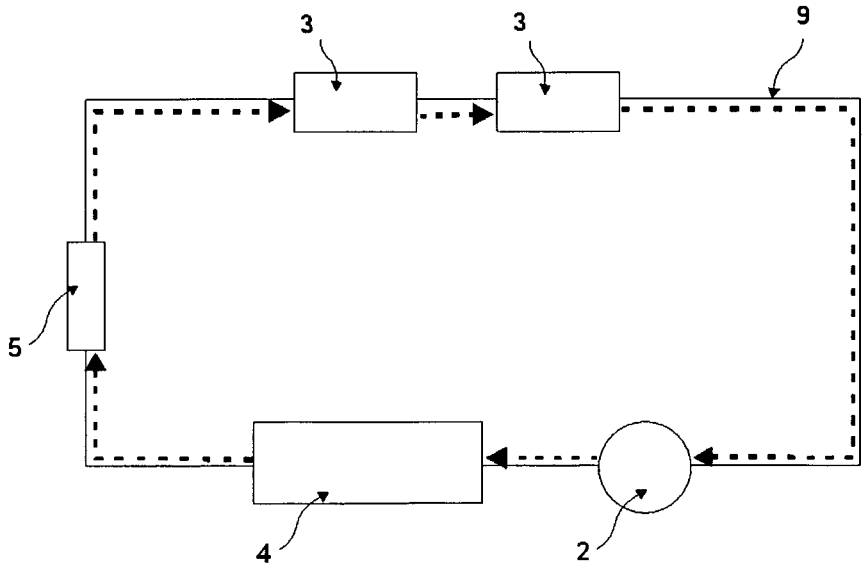
Fig. 002 PRIOR ART

FIG. 2—is a schematic view of a cooling cycle of the prior art.

Figure 3:
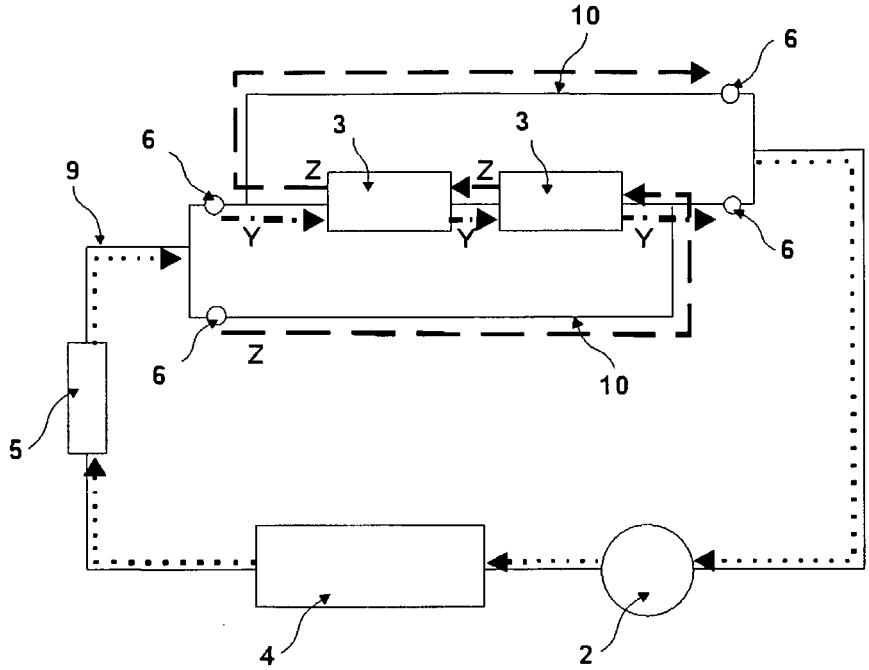

FIG. 3—is a schematic view of a cooling cycle.

Figure 4:
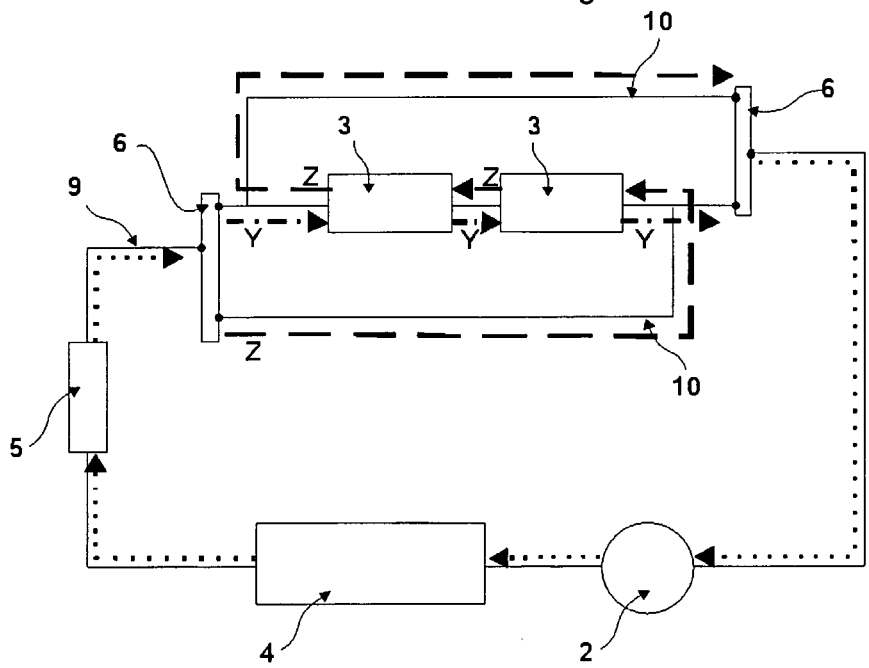

FIG. 4—is a schematic view of an alternative cooling cycle.

Figure 5:
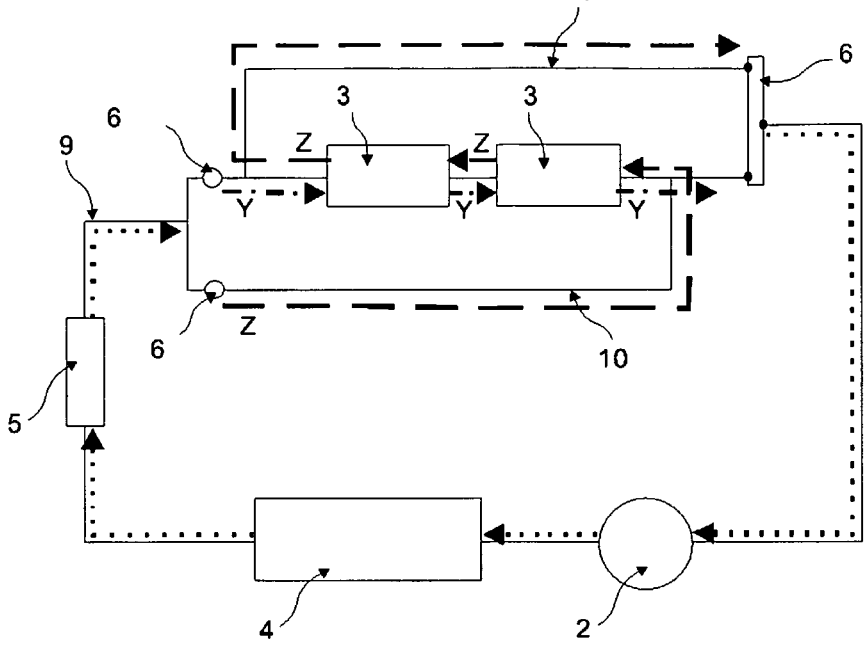

FIG. 5—is a schematic view of an alternative cooling cycle.

Elements shown in figures are numbered as follows:

1. Cooling device
2. Compressor
3. Evaporator
4. Condenser
5. Capillary tube
6. Valve
7. Compartment
8. Control unit
9. Circulation line
10. By-pass line The cooling device (1), preferably the refrigerator, comprises one or more than one compartment (7), a compressor (2) which activates the refrigeration cycle, more than one evaporators (3), at least two of them being serially-connected, absorbing the thermal energy in the medium to be cooled, a condenser (4) transferring the thermal energy to the outer medium, a capillary tube (5) enabling the expansion of the refrigerant that leaves the condenser (4) and transferring it to the evaporator, a circulation line (9) connecting the compressor (2), the evaporator (3), the condenser (4) and the capillary tube (9), more than one valves (6) on the circulation line (9), provided at the inlets or at the outlets of the evaporators (3) designating the direction and the order in which refrigeration fluid circulates through the evaporators (3), controlling the circulation during cooling cycle, one or more than one by-pass line (10) connected to at least one valve (6) and connecting to at least one evaporator (3) directly or by the circulation line (9), enabling the refrigeration fluid directed by the valve to enter the desired evaporator (3) from the desired direction.

In one embodiment of the present invention, a one way valve (6) is utilized on the cooling cycle (FIG. 3).

In another embodiment of the present invention, two way solenoid valves (6) are utilized in the cooling cycle (FIG. 4).

In another embodiment of the present invention, one way and two way valves (6) are utilized in the cooling cycle (FIG. 5).

In yet another embodiment of the present invention, a valve (6) controlling more than one inlets and outlets is utilized in the cooling cycle.

In yet another embodiment of the present invention, the cooling device (1) comprises a control unit (8) controlling the operation of the valves (6).

In the preferred embodiment of the present invention, the cooling device (1) comprises two separate compartments (7), e.g. a cooling and a freezing compartment, two serially connected evaporators (3), one in each compartment (7) for cooling the compartments (7), e.g. a cooling compartment evaporator (3) and a freezing compartment evaporator (3), a two way valve (6) positioned at the inlet of the freezing compartment evaporator (3) which is the first in the cooling cycle, e.g. a freezing valve (6), a by-pass line (10) connecting the freezing compartment valve (6) to the cooling compartment evaporator (3) which is positioned after the freezing compartment evaporator (6) in the circulation direction, e.g. a freezing by-pass line (10), a two way valve (6) which is positioned after the connection of the by pass line (10) and the cooling compartment evaporator (3), e.g. a cooling valve (6), and another by-pass line (10) connecting the cooling valve (6) to the inlet of the freezing compartment evaporator (3), e.g. a cooling by-pass line (10). In this embodiment, when the refrigeration fluid is desired to circulate through the freezing compartment evaporator (3) and the cooling compartment evaporator (3) respectively, e.g. primary circulation (Y), the freezing valve (6) opens the circulation line (9) as it blocks the freezing by-pass line (10) and the cooling valve (6) opens the circulation line (9) as it blocks the cooling by-pass line (10). Thus, refrigeration fluid enters and leaves the freezing compartment evaporator (3) and the cooling compartment evaporator (3) respectively and continues its circulation through the circulation line (9). When the refrigeration fluid is desired to circulate through the cooling compartment evaporator (3) and the freezing compartment evaporator (3) respectively, e.g. secondary circulation (Z), freezing valve (6) blocks the circulation line (9) as it opens the freezing by-pass line (10) and cooling valve (6) blocks the circulation line (9) as it opens the cooling by-pass line (10). Thus, refrigeration fluid enters and leaves the freezing by-pass line (10), the cooling compartment evaporator (3), the freezing compartment evaporator (3) and the cooling by-pass line (10) respectively and continues its circulation through the circulation line (9) (FIG. 4).

With the embodiment of the present invention, in a cooling cycle comprising serially connected evaporators (3), employment of the secondary circulation (Z) before the primary circulation (Y) starts a transient regime and as the necessary working conditions are provided, system switches to a steady-state regime, wherein the secondary circulation (Z) is employed after the primary circulation (Y).

As a result of the required positioning of the valves (6), the cooling compartment (7) evaporator (3) is given the first position and the freezing compartment (7) evaporator (3) is given the second position in the cooling cycle, thus freezing compartment (7) evaporator (3) is filled comparatively later as the compressor (2) starts operating which in turn provides a suitable cooling during the transient regime.

With the embodiment which is the object of the present invention, the evaporator (3) of the compartment (7) having a temperature higher than the ideal level is taken to the first position in the cooling cycle and thus, a better control over the compartment (7) temperatures is achieved.

Since switching between the primary circulation (Y) and the secondary circulation (Z) in the transient regime, which is achieved by the embodiment of the present invention enables the cooling compartment (7) to be cooled at a relatively higher pressure level, thermodynamic efficiency of the cooling process is improved. At the end of the transient regime, the refrigeration fluid enters the freezing compartment (7) evaporator (3) first and this results in an improvement in the efficiency.

Thus, independent of the operation of the compressor, the evaporator (3) of the compartment (7) the heat load of which is increased, is provided to be the first in the cooling cycle by suitable positioning of the valves (6) and thus, is fed with a more suitable refrigerant.

Moreover, evaporator (3) of the compartment (7) with an instantaneous heat load may be taken to the first position in the cooling cycle. As a result of the fact that the first evaporator (3) in the cooling cycle has a better performance, the evaporators (3) of the compartments (7) can cool in different activities and the temperatures of the compartments (7) may be controlled as required.

The invention claimed is:

1. A cooling device comprising at least one compartment, a compressor for activating a cooling cycle, a first evaporator and a second evaporator connected in series for absorbing the thermal energy available in a medium to be cooled and a circulation line for connecting units constituting the cooling cycle including, in order of a refrigerant circulating within the circulation line in a primary circulation mode, the compressor, a condenser, a capillary tube, at least one valve, the first evaporator, the second evaporator, and at least another valve; wherein the at least one valve is connected, via a first by-pass line and a second by-pass line, to the at least another valve, wherein the first by-pass line and the second by-pass line are connected in parallel to the circulation line with respect to the first evaporator and the second evaporator, so that the refrigerant flows, in a secondary circulation mode, from the at least one valve through the first by-pass line, the second evaporator, the first evaporator and the second by-pass line to the at least another valve.

2. The cooling device as in claim 1, further comprising a control unit for controlling the operation of the at least one valve and the at least another valve.

3. The cooling device as in claim 1, wherein the at least one valve is a one way valve utilized in the cooling cycle.

4. The cooling device as in claim 1, wherein the at least one valve is a two way valve utilized in the cooling cycle.

5. The cooling device as in claim 4, wherein the at least one compartment comprises a cooling compartment and a freezing compartment, and wherein the first evaporator and the second evaporator are located in the cooling compartment and the freezing compartment, respectively.

* * * * *